US007798872B2

(12) United States Patent
Fujino et al.

(10) Patent No.: US 7,798,872 B2
(45) Date of Patent: Sep. 21, 2010

(54) WATER JET PROPULSION BOAT

(75) Inventors: Kenichi Fujino, Shizuoka (JP); Shigeyuki Ozawa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 12/180,620

(22) Filed: Jul. 28, 2008

(65) Prior Publication Data

US 2009/0111338 A1 Apr. 30, 2009

(30) Foreign Application Priority Data

Oct. 25, 2007 (JP) ..... 2007-277847

(51) Int. Cl.
*B63H 21/22* (2006.01)

(52) U.S. Cl. ..... 440/1; 123/497; 440/88 F

(58) Field of Classification Search ..... 440/1, 440/88 F, 88 R; 123/490, 497, 509, 510, 123/514

See application file for complete search history.

(56) References Cited

U.S. PATENT DOCUMENTS 6,200,178 B1 * 3/2001 Nakase et al. ..... 440/88 R
6,210,243 B1 * 4/2001 Nakase ..... 440/88 R
7,121,265 B2 * 10/2006 Joos et al. ..... 123/494
2004/0080242 A1 * 4/2004 Ohnishi et al. ..... 123/490
2007/0251501 A1 * 11/2007 Sawut et al. ..... 123/497

FOREIGN PATENT DOCUMENTS

JP 2002-161800 A 6/2002

* cited by examiner

*Primary Examiner*—Lars A Olson
(74) *Attorney, Agent, or Firm*—Keating & Bennett, LLP

(57) ABSTRACT

A water jet propulsion boat includes a fuel pump driven by an electric control unit and arranged to deliver fuel from a fuel tank to an engine via a fuel pipe, and a fuel pressure sensor arranged to detect a pressure of the fuel delivered to the engine by the fuel pump. When a magnitude of the fuel pressure detected by the fuel pressure sensor is less than a predetermined magnitude, the fuel pump is activated. On the other hand, when the magnitude of the fuel pressure detected by the fuel pressure sensor is equal to or greater than the predetermined magnitude, the fuel pump is deactivated. Also, when the fuel pressure detected by the fuel pressure sensor becomes equal to or less than an abnormal threshold value, either one or both of the fuel pump and the engine are deactivated. The water jet propulsion boat lowers power consumption, reduces battery size, extends battery life, and lowers costs.

6 Claims, 7 Drawing Sheets

WATER JET PROPULSION BOAT

BACKGROUND OF THE INVENTION

1. Field of the Invention

The present invention relates to a water jet propulsion boat equipped with a fuel pressure detection unit arranged to detect the pressure of fuel delivered from a fuel tank to an engine by a fuel pump.

2. Description of the Related Art

Conventional water jet propulsion boats are equipped with a fuel pressure detection unit for detecting the pressure of fuel delivered from a fuel tank to an engine by a fuel pump (for example, see JP-A-2002-161800). In this conventional water jet propulsion boat, the fuel pump is mounted inside of the fuel tank, which is provided in an engine room of a boat body. When an electrical system of the engine starts, the fuel pump is activated and delivers fuel from the fuel tank to the engine by pressurizing the fuel. A fuel pressure sensor for detecting the fuel pressure is provided on a pipe connecting the fuel tank to the engine, and the fuel tank is provided with a pressure adjustment valve for stabilizing the pressure of the fuel delivered from the fuel tank to the engine. Thus, the fuel in the fuel tank can be delivered to the engine at a constant pressure adjusted by the pressure adjustment valve, and the pressure of the fuel delivered to the engine is detected by the fuel pressure sensor.

However, in the conventional water jet propulsion boat, the fuel pump is driven continuously while the engine is running in order to deliver fuel to the engine. When the engine stops, the fuel pump also stops. Because the fuel pump keeps driving while the engine is running, a large amount of power is consumed, and thus, a large size battery is required. In addition, this arrangement also shortens the life of the fuel pump. There is also the problem of the increased cost due to the installation of the pressure adjustment valve for stabilizing the pressure of the fuel delivered from the fuel tank to the engine. Furthermore, because a fuel inlet is positioned in an upper portion of the fuel pump, air enters the engine due to operation of the fuel pump when the water jet propulsion boat has overturned. Consequently, the ability of the engine to restart is decreased. Because of this, it is not desirable to continuously drive the fuel pump when a water jet propulsion boat has overturned.

SUMMARY OF THE INVENTION

In order to overcome the problems described above, preferred embodiments of the present invention provide a water jet propulsion boat that can lower power consumption, reduce battery size, extend battery life, and lower costs by eliminating a pressure adjustment valve arranged to stabilize the fuel pressure.

A water jet propulsion boat according to a preferred embodiment of the present invention is propelled by a jet pump that is actuated when an engine starts under the control of a control unit, and includes a fuel tank disposed in a boat body of the water jet propulsion boat; a fuel pipe extending from the fuel tank to the engine; a fuel pump, driven by the control unit, arranged to deliver fuel from the fuel tank to the engine via the fuel pipe; and a fuel pressure detection unit arranged to detect the pressure of the fuel delivered to the engine by the fuel pump. When a fuel pressure detected by the fuel pressure detection unit is less than a predetermined magnitude, the fuel pump is activated by the control unit. On the other hand, when the fuel pressure detected by the fuel pressure detection unit is equal to or greater than the predetermined magnitude, the fuel pump is deactivated by the control unit.

In the water jet propulsion boat according to a preferred embodiment of the present invention, the fuel pump stops operating when the fuel pressure detected by the fuel pressure detection unit is large enough to supply the engine with fuel. On the other hand, when the fuel pressure detected by the fuel pressure detection unit is less than the predetermined magnitude, for example, when the fuel pressure is small and just barely greater than a minimum magnitude required to supply the engine with fuel, the fuel pump is activated. Therefore, because the amount of power consumed by driving the fuel pump is minimized, it is possible to save electricity.

As a result, it is possible to reduce the battery size thereby reducing costs. Also, because the fuel pump is minimally driven, the life of the fuel pump can be extended. Furthermore, the pressure adjustment valve is no longer necessary because the fuel pressure is adjusted by controlling the operation of the fuel pump in accordance with the fuel pressure detected by the fuel pressure detection unit. The predetermined magnitude can be any magnitude, however, it is preferable that the predetermined magnitude is less than a median magnitude within a range of fuel pressures required to supply the engine with fuel.

In the water jet propulsion boat according to a preferred embodiment of the present invention, either both or one of the fuel pump and the engine is deactivated by the control unit when the fuel pressure detected by the fuel pressure detection unit becomes equal to or less than an abnormal threshold value that is less than the predetermined magnitude.

According to the unique construction described above, either one or both of the fuel pump and the engine are deactivated when the fuel pressure detected by the fuel pressure detection unit drops abnormally due to air suctioning caused by the fuel pump when the water jet propulsion boat overturns or the like. Therefore, it is possible to immediately prevent air suctioned into the fuel pump from entering the engine through the fuel pump. As a result, the engine will start smoothly when the engine is restarted after a deactivation.

Normally, a water jet propulsion boat is provided with an overturn sensor arranged to detect when the boat overturns. However, according to a preferred embodiment of the present invention, it is possible to detect overturning of the water jet propulsion boat just by using the fuel pressure detected by the fuel pressure detection unit. When the fuel pressure detected by the fuel pressure detection unit becomes equal to or less than the abnormal threshold value, it is possible to detect when the boat has overturned. Because of this, the overturn sensor becomes unnecessary. This makes it possible to lower costs further. It is preferable that the abnormal threshold value be significantly lower than the minimum fuel pressure required for normal engine operation, and also is a magnitude that indicates that the fuel pump is suctioning air.

In the water jet propulsion boat according to a preferred embodiment of the present invention, either one or both of the fuel pump and the engine are deactivated by the control unit when the fuel pressure detected by the fuel pressure detection unit remains equal to or less than the abnormal threshold value for a predetermined period of time.

For example, it is not desirable that either the fuel pump or the engine stop in a case where the water jet propulsion boat is temporarily overturned but then immediately returns back to a normal operating condition. Also, even in a case where the water jet propulsion boat is not overturned but operates normally, when a remaining amount of the fuel is low, the fuel pump may occasionally suction air due to, for example, shaking of the boat body. However, it is not desirable for either the fuel pump or the engine to stop under such circumstances as long as the water jet propulsion boat is operating normally. This is because it seems unlikely that the fuel pump would continuously suction air while the water jet propulsion boat operates normally and also because, in this case, a small amount of air temporarily suctioned into the fuel pump has little effect on the engine.

Therefore, it is only when the pressure detected by the fuel pressure detection unit is equal to or less than the abnormal threshold value and remains so over the predetermined period of time, which is set in advance as a period at which the occurrence of the abnormality can be detected, that either both or one of the fuel pump and the engine is deactivated. Consequently, it is possible to avoid unnecessary deactivation of the fuel pump and/or the engine. Also, according to a preferred embodiment of the present invention, it is possible to detect both overturning of the water jet propulsion boat and running out of fuel without the use of an overturn sensor because of the detection of a fuel pressure that remains equal to or less than the abnormal threshold value over the predetermined period of time.

In the water jet propulsion boat according to a preferred embodiment of the present invention, the fuel pump is provided in the fuel tank and the fuel pressure detection unit is preferably attached to a downstream portion of the fuel pump in the fuel tank.

Normally, the fuel tank is attached to the boat body at a position that maintains a predetermined distance from the engine via a vibration-proofing member such as a rubber mount, for example. Therefore, because the fuel pressure detection unit is provided in the fuel tank, vibrations such as engine vibrations and swinging of the boat body is not transmitted to the fuel pressure detection unit. Consequently, detection errors by the fuel pressure detection unit are minimized, and the life of the fuel pressure detection unit can be extended by preventing it from breaking. In addition, because the fuel pressure detection unit is placed in proximity of the fuel pump, it is possible to immediately detect a decrease in the fuel pressure when the fuel pump suctions air. Furthermore, it is possible to prevent vibrations from being transmitted to the fuel pressure detection unit by attaching the fuel pressure detection unit to the fuel tank via an attachment member made up of the vibration-proofing member and the like.

The water jet propulsion boat according to a preferred embodiment of the present invention preferably has the fuel pressure detection unit attached to an inside of the fuel tank. According to this structure, because the fuel pressure detection unit is soaked in fuel (including the evaporated fuel) in the fuel tank, the fuel pressure detection unit is protected against corrosion caused by its exposure to seawater. Thereby, it is possible to extend the life of the fuel pressure detection unit.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
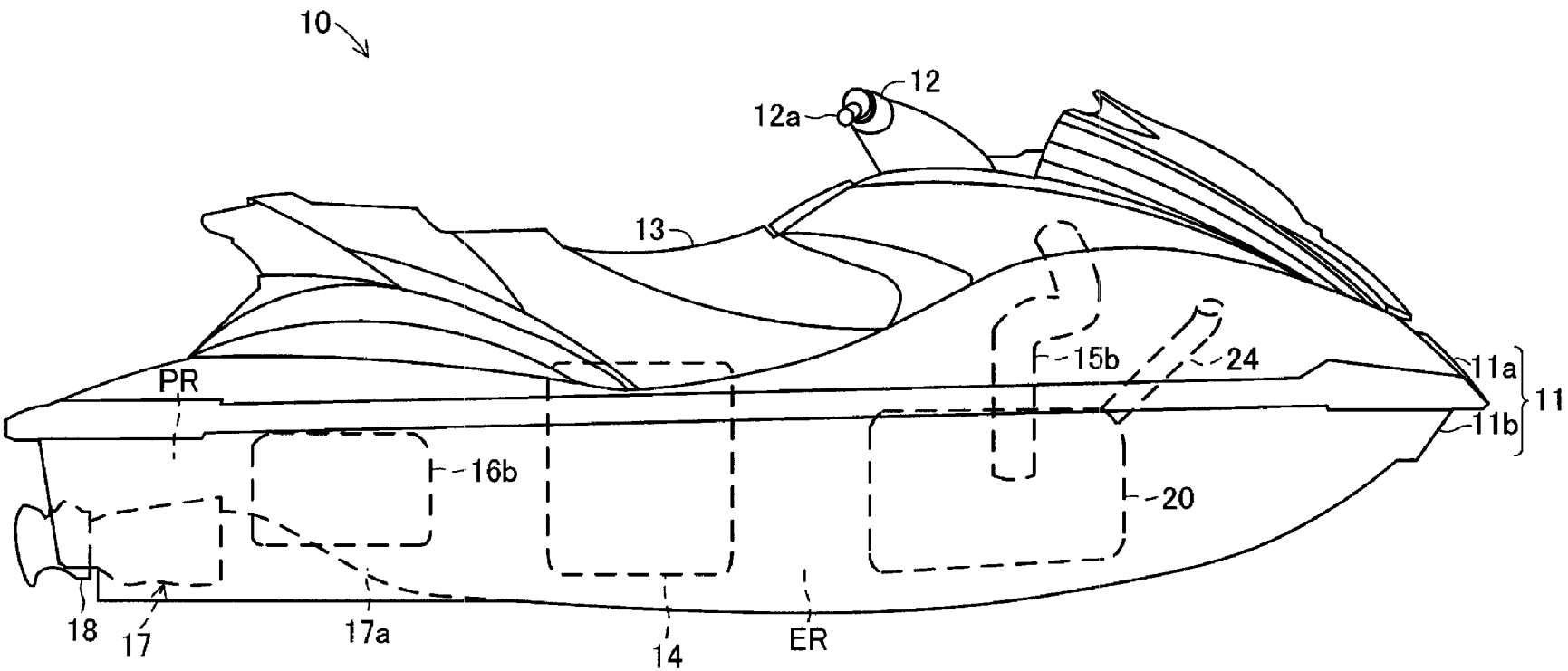
FIG. 1 is a side view showing a water jet propulsion boat according to a preferred embodiment of the present invention.
Figure 2:
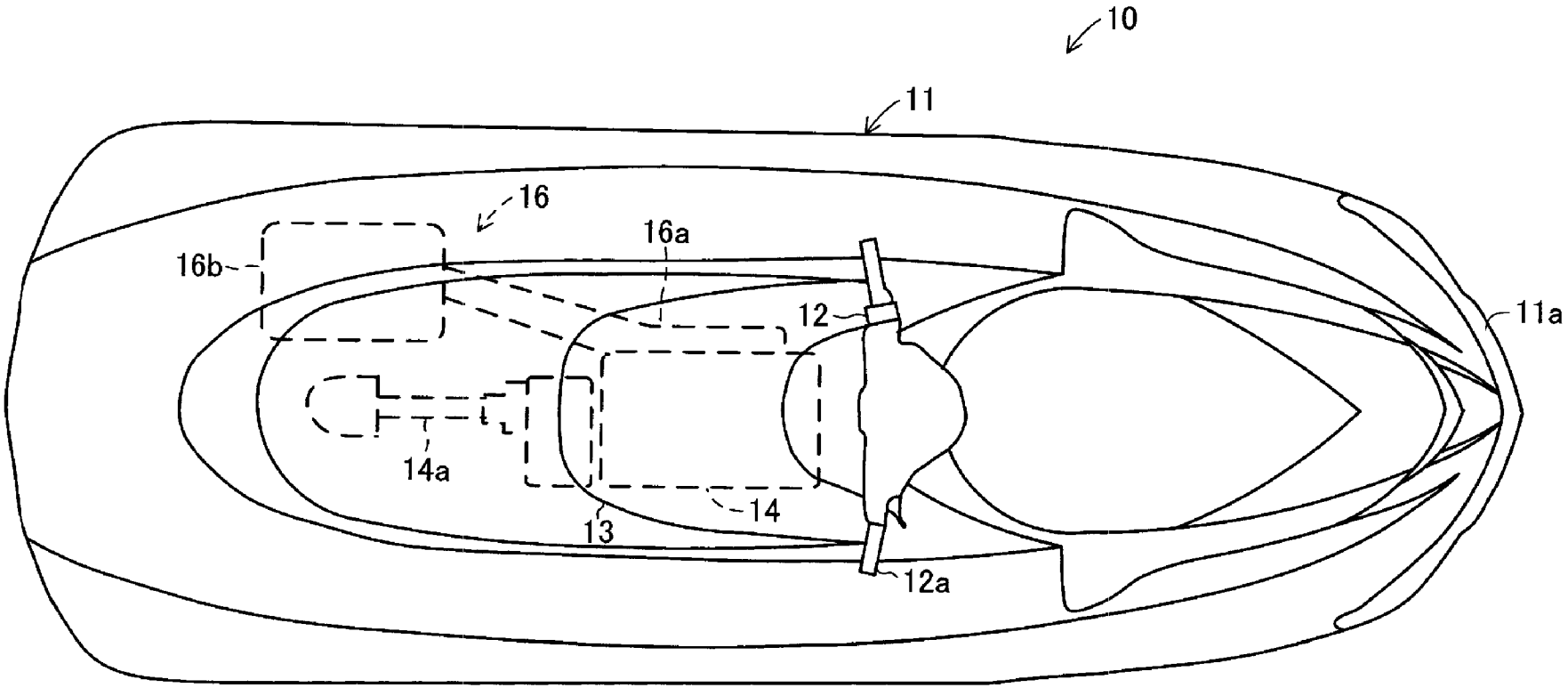
FIG. 2 is a plan view of the water jet propulsion boat shown in FIG. 1.

Preferred embodiments of the present invention are hereinafter described with reference to the drawings. FIGS. 1 and 2 show a water jet propulsion boat 10 according to a preferred embodiment. In the water jet propulsion boat 10, a boat body 11 includes a deck 11*a* and a hull 11*b*. Steering handlebars 12 are disposed in the front of an upper portion of the boat body 11, and a seat 13 is disposed at the center in the upper portion of the boat body 11. The steering handlebars 12 are rotatably attached to an upper end of a steering shaft (not shown) disposed on the boat body 11.

A throttle lever (not shown) is disposed adjacent to a grip 12*a* on a right side (a starboard side) of the steering handlebars 12. The throttle lever is adapted to be pivoted toward the grip 12*a* when a boat operator operates the throttle lever, and pivoted away from the grip 12*a* when the operator releases the throttle lever. An accelerator position sensor (not shown) arranged to detect an operation amount of the throttle lever is provided on a wire connected to the throttle lever.

The interior of the boat body 11 includes an engine room ER that extends from the front portion to a central portion, and a pump room PR located in the rear portion. The engine room ER is provided with a fuel tank 20, an engine 14, an intake system 15 (see FIG. 6) including a throttle valve 15*a*, etc., and an exhaust system 16 including an exhaust manifold 16*a*, etc. The pump room PR is provided with a propulsion unit 17 including a jet pump, etc. An air duct 15*b* to introduce external air into the engine room is disposed in the front portion of the engine room ER. The air duct 15*b* extends vertically from the upper portion of the boat body 11 to the bottom portion of the engine room ER. The air duct 15*b* suctions external air from the upper end and introduces it into the bottom end then to the engine room ER.

Figure 3:
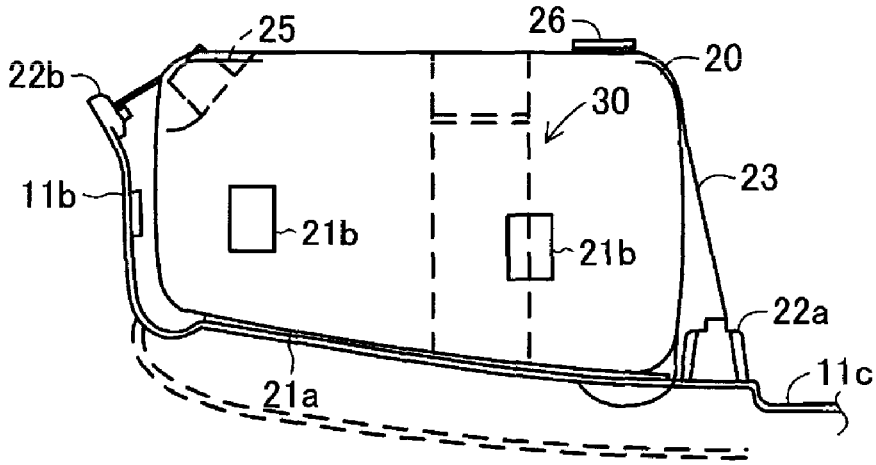
FIG. 3 is a cross-sectional view of a mounting structure of a fuel tank as seen from the side.
Figure 4:
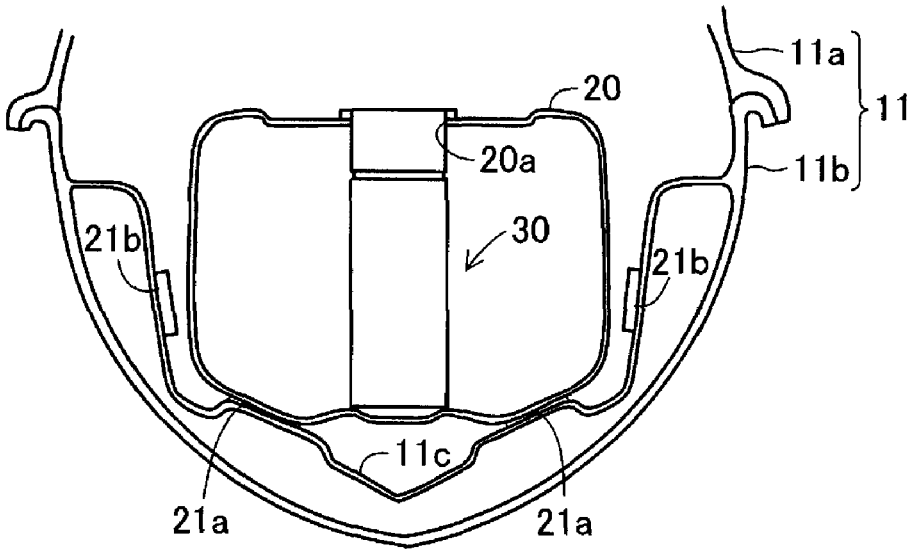
FIG. 4 is a cross-sectional view of the mounting structure of the fuel tank as seen from the front.

A fuel tank 20 is disposed at the front portion of the engine room ER as shown in FIGS. 3 and 4. The hull 11*b* defining the bottom portion of the boat body 11 is preferably built to have a dual structure in which the fuel tank 20 is mounted through a plurality of vibration dampeners 21*a*, 21*b*, on an inner wall 11*c* defining the inner structure of the hull 11*b*. The vibration dampeners 21*a* are preferably disposed in two places, for example, on both sides supporting the bottom of the fuel tank 20 on the bottom surface of the inner wall 11*c*. The vibration dampeners 21*b* are preferably disposed in three places, for example, that oppose the side surfaces of the inner wall 11*c* other than the rear surface of the fuel tank 20. Fastening hardware 22*a* is fixed on the inner wall 11*c* where the bottom rear end of the fuel tank 20 is located. Another fastening hardware 22*b* is fixed on the inner wall 11*c* (hull 11*b*) where the upper front end of the fuel tank 20 is located.

A belt 23 is wound around the fuel tank 20 through the fastening hardware 22*a* and the fastening hardware 22*b*, so the upper surface of the fuel tank 20 is pressed down against the inner wall 11*c*. Therefore, the fuel tank 20 is supported by the inner wall 11*c* in a way that the vibration of the boat body 11 is absorbed by the vibration dampener 21*a* and not transmitted directly to the fuel tank 20. In a case that the fuel tank 20 deviates horizontally, the impact from the inner wall 11*c* on the side surface of the fuel tank 20 can be minimized by the vibration dampeners 21*b*.

The fuel tank 20 is preferably a generally rectangular-shaped container including a bottom wall. The bottom wall is inclined so that the front portion of the bottom wall is higher than the rear portion of the bottom wall. An opening 20*a* is provided in the top wall of the fuel tank 20, centrally in a left-right direction and rather rearward thereof. A connecting opening 25, which is in fluid communication with an oil feed pipe 24 extending from an oil feed inlet in the deck 11*a*, is provided in the upper front end of the fuel tank 20. An opening that can be opened and closed with a lid 26 is provided in the upper rear end of the fuel tank 20. A fuel pump module 30 is disposed in the fuel tank 20 with its upper surface being exposed through the opening 20*a*.

Figure 5:
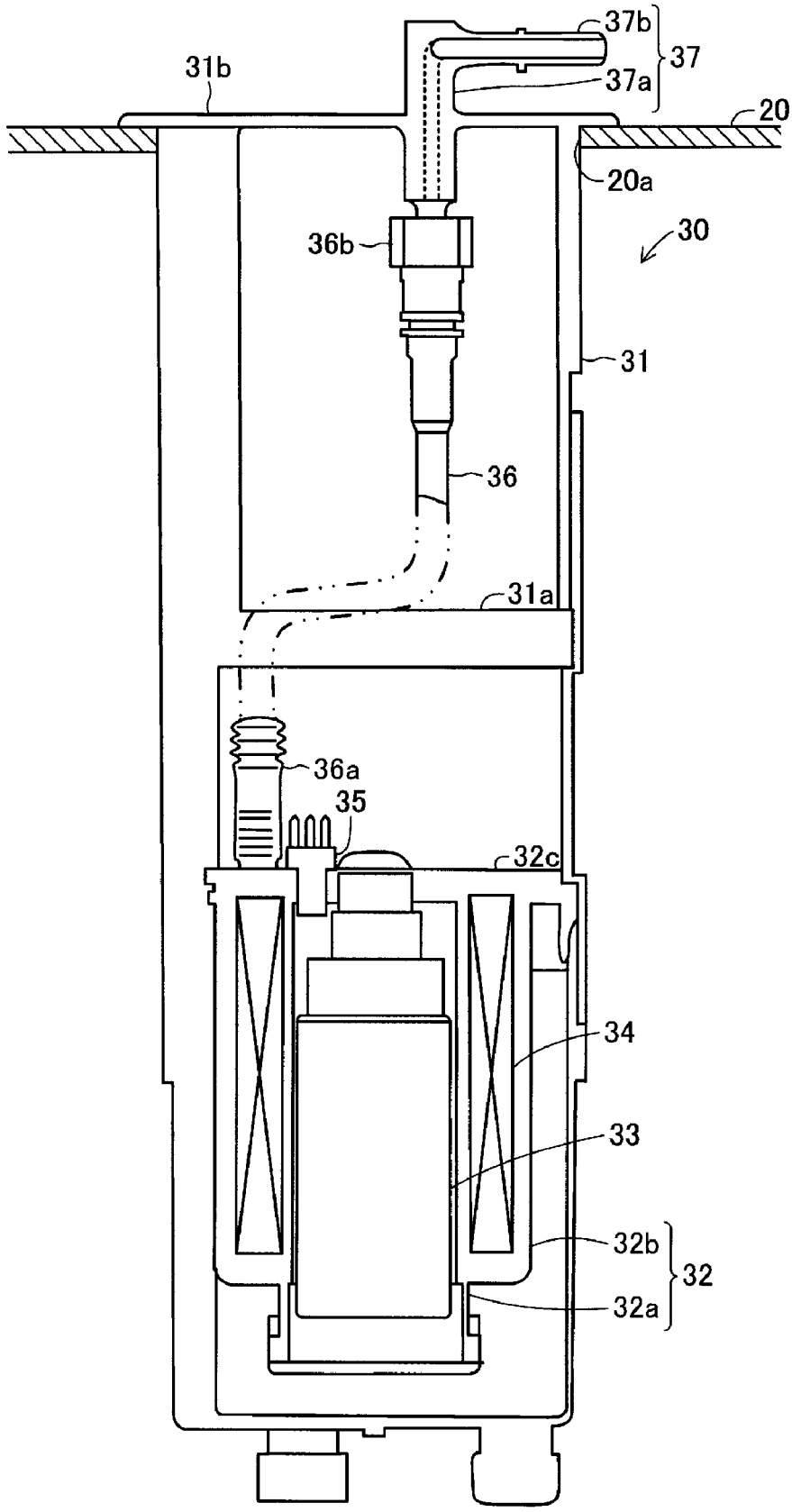
FIG. 5 is a cross-sectional view of a fuel pump module.

As shown in FIG. 5, the fuel pump module 30 is preferably formed by dividing an elongated cylindrical container 31 into an upper room and a lower room with a partition 31*a*. A fuel pump 33, a filter 34, and a fuel pressure sensor 35 as a fuel pressure detection unit are housed in the lower room through a container 32, and a connecting pipe 36 is disposed in the upper room. A container 32 includes a pump housing section 32*a* to contain the fuel pump 33 and a case member having a filter housing section 32*b* to contain the filter 34. The cylindrical pump housing section 32*a* is located at the center of the housing 32. The annular filter housing section 32*b* is arranged around the outer surface of the pump housing section 32*a* except for the bottom surface.

The fuel pressure sensor 35 is disposed in a position on an upper surface 32*c* of the container 32, corresponding to the front portion (left side in FIG. 5) of the pump housing section 32*a*. The fuel pressure sensor 35 is in communication with the inside of the pump housing section 32*a*. A suction port (not shown) arranged to suction the fuel into the fuel pump 33 from the fuel tank 20 by operation of the fuel pump 33 extends from the bottom surface of the container 31 to the upper surface of the bottom wall of the pump housing section 32*a*. A discharge port (not shown) arranged to discharge the fuel suctioned in the pump housing section 32*a* through the fuel pump 33 is arranged between the upper portion of the pump housing section 32*a* and the filter housing section 32*b*.

A grommet 36*a* is disposed on the upper surface 32*c* of the container 32, corresponding to the front portion of the filter housing section 32*b*, next to the fuel pressure sensor 35. The grommet 36*a* is in communication with the inside of the filter housing section 32*b*. The grommet 36*a* is connected to the lower portion of the connecting pipe 36. The connecting pipe 36 extends through the partition 31*a* into the upper room of the container 31. A check valve 36*b* is disposed at the upper end of the connecting pipe 36. The connecting pipe 36 is connected, through the check valve 36*b*, to a fuel discharge section 37 provided on the top wall 31*b* of the cylindrical container 31. The fuel discharge section 37 is defined by a body portion 37*a* and a connecting portion 37*b*. The body portion 37*a* extends from the inside of the container 31 to the outside through the top wall 31*b* of the container 31. The connecting portion 37*b* is bent at the upper end of the body portion 37*a* and then extends horizontally rearward. The connecting portion 37*b* is connected to an upstream end of a rubber fuel pipe 38 (see FIG. 6).

Therefore, when the fuel pump 33 is operated, the fuel in the fuel tank 20 is drawn from the suction port through the fuel pump 33 into the pump housing section 32*a* and then discharged into the filter housing section 32*b*. At the same time, the fuel pressure is detected by the fuel pressure sensor 35 positioned in the vicinity of the discharge port. The fuel discharged to the filter housing section 32*b* is filtered by the filter 34 in order to remove foreign matter and then drawn into the engine 14 through the connecting pipe 36, the fuel pipe 38, and the like. The fuel delivered from the connecting pipe 36 through the fuel discharge section 37 to the fuel pipe 38 is drawn towards the engine 14 in a state that backflow of the fuel is prevented by the check valve 36*b*.

The engine 14 is disposed at the rear portion of the engine room ER (approximately central portion of the bottom in the boat body 11). The intake system 15 and the exhaust system 16 are connected to the engine 14. The intake system 15 sends an air-fuel mixture made up of the fuel supplied from the fuel tank 20 and the air introduced from the outside. The exhaust system 16 discharges the exhaust gas emitted by the engine 14 to the outside through a rear end portion of the boat body 11. Though not shown, the engine 14 is preferably a four-cycle, four-cylinder engine, but could be any other type of engine. With opening and closing operations of an intake valve and an exhaust valve provided for each cylinder, the engine 14 introduces the air-fuel mixture from the intake system 15 provided on the intake valve side and sends the exhaust gas to the exhaust system 16 provided on the exhaust valve side.

At this time, the air-fuel mixture supplied to the engine 14 from the intake valve explodes by ignition of an ignition device that is made up of a spark plug and the like provided in the engine 14, and the explosion causes the piston provided in each cylinder of the engine 14 to reciprocate. The motion of the piston rotates a crankshaft. The crankshaft is coupled to an impeller shaft 14*a* and transmits the rotational force of the engine 14 to the impeller shaft 14*a*. Also, a rear end portion of the impeller shaft 14*a* is coupled to an impeller (not shown) of the propulsion unit 17 disposed at the rear end of the boat body 11. The rotation of the impeller generates the propulsive force in the water jet propulsion boat 10.

The propulsion unit 17 includes a water inlet 17*a* open at the bottom of the boat body 11 and a water outlet (not shown) open at the stern. The propulsion unit 17 introduces seawater from the water inlet 17*a*, and ejects it from the water outlet by the rotation of the impeller to generate the propulsive force for the boat body 11. A steering nozzle 18 is attached to the rear end portion of the propulsion unit 17. The rear portion of the steering nozzle 18 is rotatable in the left or right direction. The advancing direction of the water jet propulsion boat 10 is controlled by the operation of the steering handlebars 12.

Figure 6:
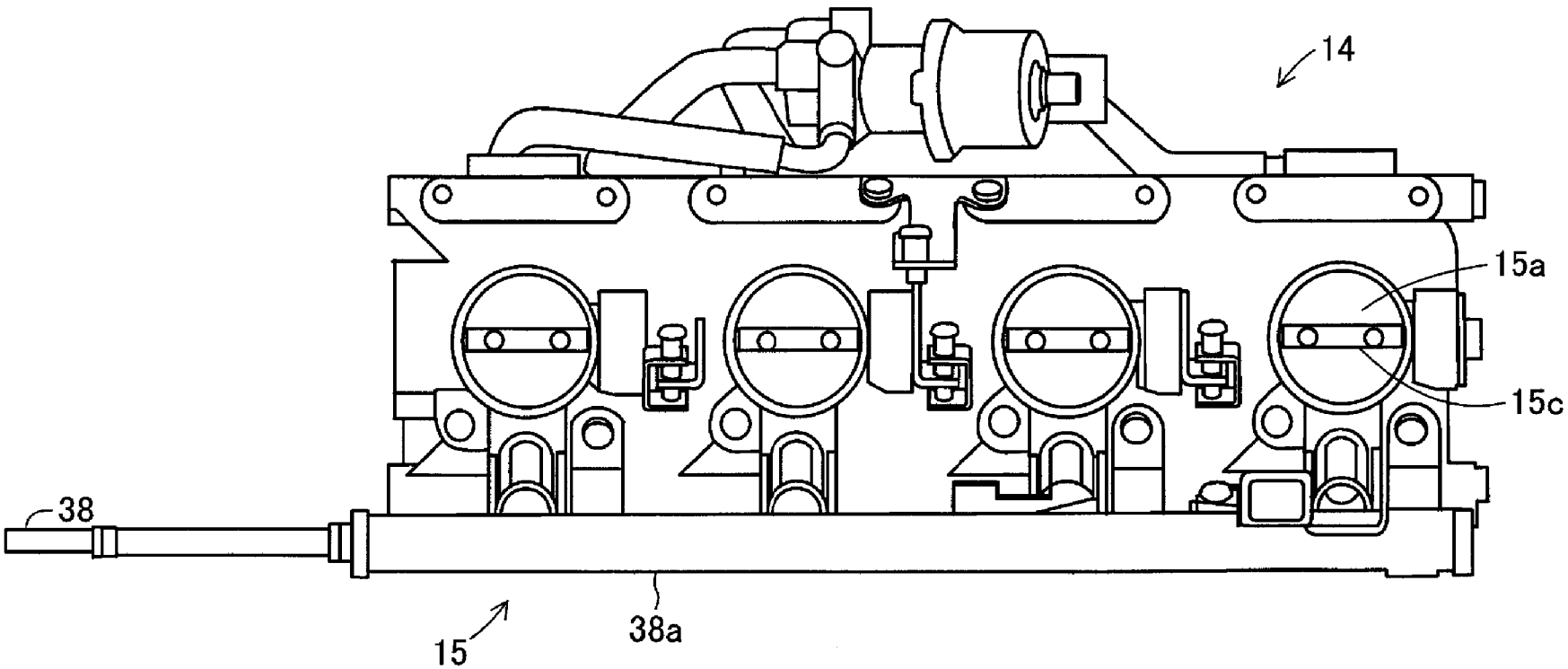
FIG. 6 is a plan view of a positional relationship between an engine and a fuel rail.

The intake system 15 includes intake pipes connected to the engine 14, throttle bodies connected to the intake pipes, and other components. The intake system 15 suctions air from the outside through the air duct 15*b*, an intake box (not shown), and the like, adjusts the air flow by the opening or closing operation of the throttle valve 15*a* disposed in the throttle body, and then supplies the air to the engine 14. At the same time, the fuel is mixed with the air to be supplied to the engine 14. The fuel is delivered from the fuel tank 20 to the intake valve in each cylinder of the engine 14 through the fuel pipe 38 and a fuel rail 38*a* including a metal pipe as shown in FIG. 6.

Also, the throttle valve 15*a* preferably has a disk shape. A pivot shaft 15*c* is affixed thereto at an approximately central portion (in a diameter direction). The pivot shaft 15*c* is pivotally supported within the throttle body. A motor is connected to one end of the pivot shaft 15*c*. Thus, the throttle valve 15*a* pivots in a forward or reverse direction about the pivot shaft 15*c* with a rotary drive of the motor to open or close an intake passage extending in the throttle body. The adjustment of the throttle valve opening is made by the rotating operation of the throttle lever disposed on the steering handlebars 12.

The exhaust system 16 preferably includes the exhaust manifold 16*a*, a tank-like water lock 16*b*, and the like. The exhaust manifold 16*a* includes a curving pipe connected to the engine 14. The water lock 16*b* is connected to a rear end of the exhaust manifold 16*a*. Each exhaust manifold 16*a* extends from the exhaust valve in each cylinder of the engine 14, gathers at the starboard side of the boat body 11, extends toward a port side of the boat body 11 so as to surround the front portion of the engine 14, extends rearward passing the vicinity of the side portion of the engine 14, and then is in communication with a front portion of the water lock 16*b*. An exhaust pipe is disposed on the upper surface of the rear portion of the water lock 16*b*. The exhaust pipe extends upward then downward to the rear, and opens at the rear end lower portion of the boat body 11. The exhaust system 16 discharges the exhaust gas to the outside such that external seawater or the like is prevented from entering the engine 14.

Figure 7:
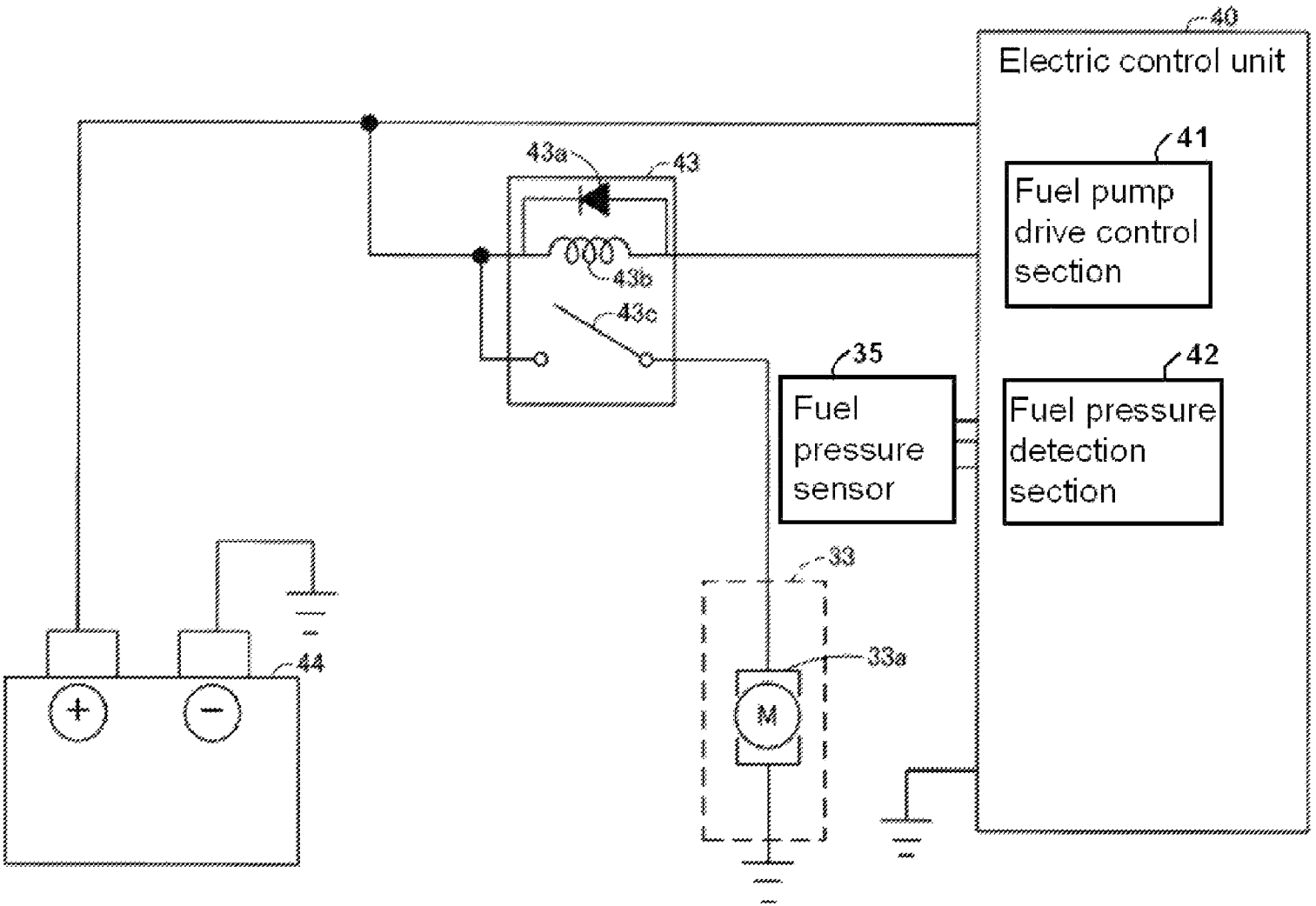
FIG. 7 is a schematic diagram of devices arranged to control the drive of the fuel pump.

Also, in addition to the aforementioned devices, the water jet propulsion boat 10 according to a preferred embodiment of the present invention is provided with an electric control unit 40 that includes a fuel pump drive control section 41 and a fuel pressure detection section 42 shown in FIG. 7, a fuel pump relay 43, a battery 44, a fuel pump motor 33*a* included in the fuel pump 33, and other various devices including various switches and sensors such as a start switch required for the safe operation of the water jet propulsion boat 10. The electric control unit 40 preferably includes a CPU, ROM, RAM, timer, and the like. The fuel pump drive control section 41 and the fuel pressure detection section 42 perform a certain portion of each program executed by the CPU, etc.

The accelerator position sensor, the fuel pressure sensor 35, the fuel pump relay 43, and the battery 44 are preferably connected to the electric control unit 40 via a lead wire. The fuel pump motor 33*a* of the fuel pump 33 is connected to the electric control unit 40 via the lead wire and the fuel pump relay 43. The fuel pressure detected by the fuel pressure sensor 35 is transmitted to the fuel pressure detection section 42 as a signal, and the fuel pressure detection section 42 determines the fuel pressure based on the signal. The fuel pump drive control section 41 controls the performance of the fuel pump relay 43 based on the determination of the fuel pressure detection section 42.

The fuel pump relay 43 preferably includes a diode 43*a*, a coil 43*b*, and a contact 43*c*. When a predetermined electric current flows in the coil 43*b*, the contact 43*c* closes, and then the fuel pump motor 33*a* connected to the contact 43*c* starts rotating. When the coil 43*b* stops energizing, the contact 43*c* opens and the fuel pump motor 33*a* stops rotating. The diode 43*a* absorbs the counter-electromotive force generated at the ON and OFF operations of the contact 43*c*. The fuel pump 33 starts or stops its drive based on the control by the fuel pump drive control section 41 in accordance with the programs stored in the ROM or various data stored in the RAM.

Figure 8:
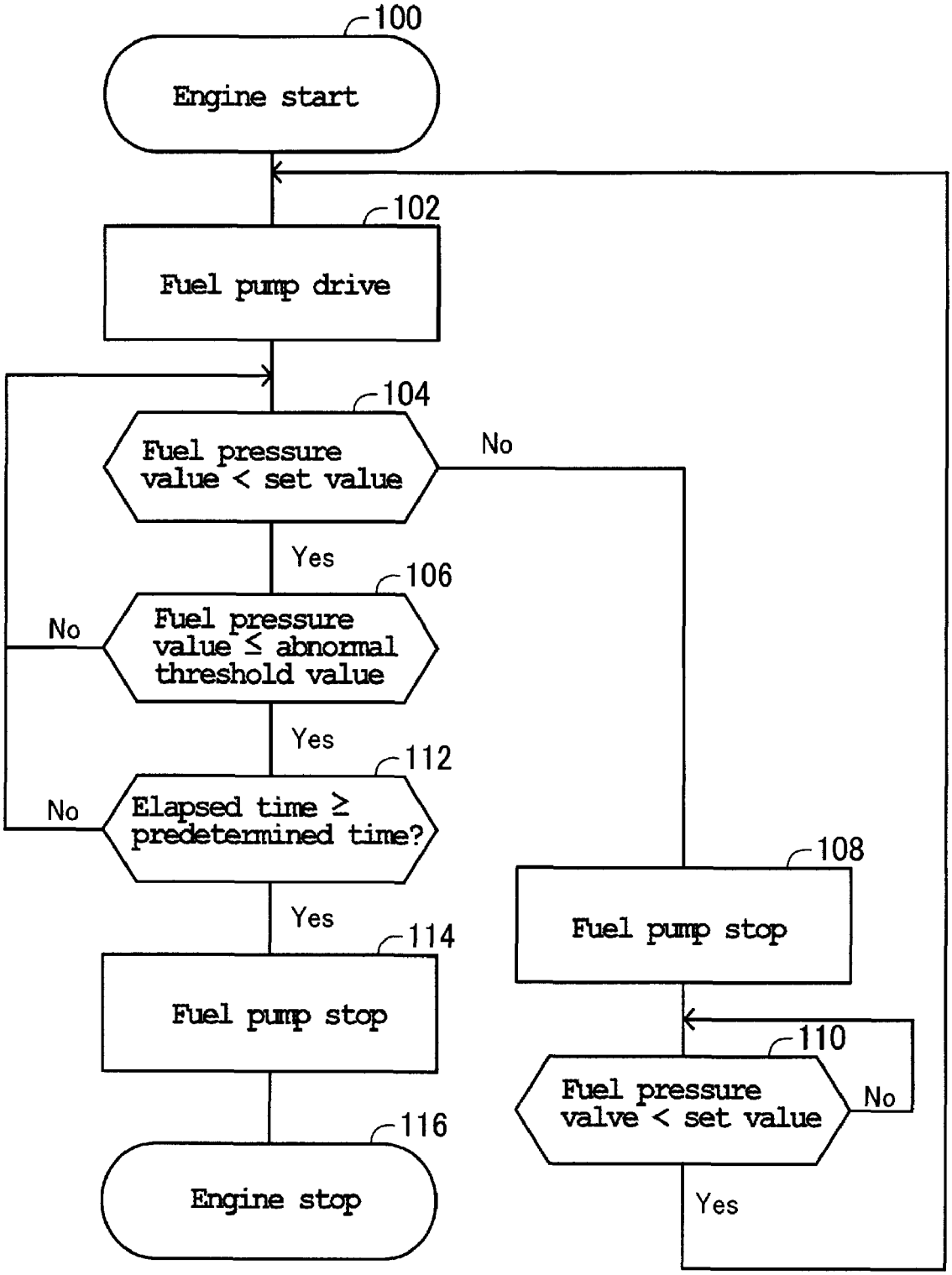
FIG. 8 is a flow chart showing a program for executing the drive control of the fuel pump.

In a preferred embodiment of the present invention, the RAM stores data such as a predetermined magnitude smaller than a median magnitude in a range of the fuel pressure required for driving the engine 14, data of the abnormal threshold value outside the range of the normal magnitudes of the fuel pressure detected by the fuel pressure sensor 35, and data of the time period for determining the occurrence of an abnormality. A program shown in FIG. 8 is preferably stored in the ROM. The throttle valve 15*a* is connected to the electric control unit 40 via the motor, and operates the engine 14 by the control of the electric control unit 40 according to the operation amount of the throttle lever detected by the accelerator position sensor.

In order to start the water jet propulsion boat 10 as described above, initially the start switch is turned on to start the engine 14, and the water jet propulsion boat 10 becomes ready to operate. When the operator seated on the seat 13 operates the steering handlebars 12 and the throttle lever, the water jet propulsion boat 10 starts moving in a direction at a speed corresponding to the respective operations by the operator. At this time, the fuel pump 33 is preferably operated following the program shown in FIG. 8.

Initially, once the engine 14 starts at step 100, the program proceeds to step 102 to start the fuel pump 33. Accordingly, the fuel in the fuel tank 20 is suctioned into the fuel pump 33. After foreign matter is removed by the filter 34, the fuel is delivered to the engine 14 via a connecting pipe 36, a fuel pipe 38, and the like. Next, at step 104, it is determined whether or not a magnitude of the fuel pressure detected by the fuel pressure sensor 35 is less than the predetermined magnitude. Here, if the fuel pressure magnitude is less than the predetermined magnitude, a "Yes" response is provided, and the program proceeds to step 106.

At step 106, it is determined whether or not the fuel pressure magnitude is equal to or less than the abnormal threshold value, that is, whether or not the fuel pressure is abnormally decreased due to air suctioning by the fuel pump 33 caused by overturning of the water jet propulsion boat 10 and the like. If the water jet propulsion boat 10 is operating normally, and the fuel pressure magnitude is within the normal magnitude range, a "No" response is provided at step 106, and then the program proceeds to step 104. During a time period between "Yes" at step 104 and "No" at step 106, the fuel pump 33 keeps operating, and the fuel pump drive control section 41 and the fuel pressure detection section 42 repeatedly execute the process in steps 104 and 106.

Then, when it is determined that the fuel pressure magnitude detected by the fuel pressure sensor 35 is equal to or greater than the predetermined magnitude, and a "No" response is provided at step 104, the program proceeds to step 108. At step 108, the fuel pump 33 is stopped. According to the present preferred embodiment, the engine 14 keeps running under a condition in which the fuel supply from the fuel pump 33 to the engine 14 is temporarily stopped. Then, at step 110, it is determined whether or not the detected magnitude of the fuel pressure is less than the predetermined magnitude. If the fuel pressure magnitude is equal to or greater than the predetermined magnitude, a "No" response is provided, and the program once again executes the process at step 110. As long as the fuel pressure magnitude is equal to or greater than the predetermined magnitude, the fuel pump 33 remains deactivated.

Then, when the detected magnitude of the fuel pressure becomes less than the predetermined magnitude, and a "YES" response is provided at step 110, the program proceeds to step 102. At step 102, the process to drive the fuel pump 33 is executed. Then, until the "Yes" response is provided at step 106, the fuel pump 33 keeps driving in a case where the fuel pressure magnitude is less than the predetermined magnitude. If the fuel pressure magnitude is equal to or greater than the predetermined magnitude, the drive of the fuel pump 33 stops and the process at steps 102 to 110 is repeated.

When the fuel pressure magnitude becomes equal to or less than the abnormal threshold value due to air suctioning by the fuel pump 33 caused by overturning of the water jet propulsion boat 10 or the swinging of the fuel tank 20 in which the remaining amount of the fuel is apparently decreased, a "Yes" response is provided at step 106, and the program proceeds to step 112. At step 112, it is determined whether or not an elapsed time since the "Yes" response is provided at step 106 is equal to or longer than a predetermined time period. This determination is made to determine if the fuel pressure magnitude is equal to or less than the abnormal threshold value is merely instantaneous or continuous. The predetermined time period is such that it is able to determine that a state continues in which the fuel pressure magnitude becomes equal to or less than the abnormal threshold value, such as when air suctioning by the fuel pump caused by overturning of the water jet propulsion boat 10 continues.

Here, if the fuel pressure magnitude temporarily becomes equal to or less than the abnormal threshold value, and a "No" response is provided at step 112, the program proceeds to step 104. Then, the process at steps 104 to 112 is once again executed to repeat the process of starting the fuel pump 33 if the fuel pressure magnitude is less than the predetermined magnitude, or stopping the fuel pump 33 if the fuel pressure magnitude is equal to or greater than the predetermined magnitude. During this time, even if the fuel pressure magnitude becomes equal to or less than the abnormal threshold value, and a "Yes" response is provided at step 106, the process at steps 104 to 112 is repeated as long as the elapsed time is shorter than the predetermined time period, and thus, a "No" response is provided at step 112.

When the water jet propulsion boat 10 is overturned and remains so, and the state in which the fuel pressure magnitude is equal to or less than the abnormal threshold value continues over the predetermined time period, and a "Yes" response is provided at step 112, the program proceeds to step 114. At step 114, the process to stop the fuel pump 33 is executed. Then, the program proceeds to step 116 to stop the engine 14, and the process is terminated. If the engine 14 is restarted, the aforementioned process is repeated.

As described above, in the water jet propulsion boat 10 according to a preferred embodiment of the present invention, if the fuel pressure magnitude detected by the fuel pressure sensor 35 is equal to or greater than the predetermined magnitude, the fuel pump 33 is stopped. The fuel pump is activated only when the fuel pressure magnitude detected by the fuel pressure sensor 35 is less than the predetermined magnitude. Therefore, because the amount of power consumed to drive the fuel pump 33 is reduced, it is possible to save electricity. As a result, it is possible to downsize the battery 44 and thus reduce the overall cost. Also, because the fuel pump 33 is minimally driven, the life of the fuel pump 33 can be extended. Further, because the fuel pressure is adjusted by controlling the drive of the fuel pump 33 in accordance with the fuel pressure magnitude detected by the fuel pressure sensor 35, the fuel adjustment valve becomes unnecessary.

In the water jet propulsion boat 10 according to a preferred embodiment of the present invention, the fuel pump 33 and the engine 14 are deactivated when the fuel pressure magnitude detected by the fuel pressure sensor 35 becomes equal to or less than the abnormal threshold value due to air suctioning by the fuel pump 33 caused by overturning of the water jet propulsion boat 10 and the like, and remains so for the predetermined period of time. Therefore, when the fuel pressure magnitude temporarily drops to be equal to or less than the abnormal threshold value, the water jet propulsion boat 10 operates in a normal state, and it is possible to avoid the unnecessary deactivation of the fuel pump 33 and the engine 14. Also, it is possible to detect overturning of the water jet propulsion boat 10 and the running out of the fuel without an overturn sensor because of the detection of the fuel pressure magnitude that remains less than the abnormal threshold value over the predetermined period of time.

In the water jet propulsion boat 10 according to a preferred embodiment of the present invention, the fuel pump module 30 provided with the fuel pump 33 is preferably disposed in the fuel tank 20 supported by the boat body 11 via the vibration dampeners 21*a* and 21*b*. The fuel pressure sensor 35 is preferably attached to the downstream portion of the fuel pump 33 in the fuel pump module 30. Therefore, it is difficult to transmit the vibrations of the engine 14 to the fuel pressure sensor 35, and thus, it eliminates the occurrence of detection errors by the fuel pressure sensor 35. Also, the life of the fuel pressure sensor 35 can be extended by preventing it from breaking. In addition, because the fuel pressure sensor 35 is placed in proximity with the fuel pump 33, it is possible to immediately detect a decrease in the fuel pressure when the fuel pump 33 suctions air. Furthermore, because the fuel pressure sensor 35 is attached inside the fuel tank 20, the fuel pressure sensor 35 is soaked in the fuel (including the evaporated fuel) and can be protected against corrosion caused by exposure to seawater.

The water jet propulsion boat of the present invention is not limited to the preferred embodiments described above and can be practiced with appropriate modifications. For example, in one of the preferred embodiments described above, the fuel pump 33 and the engine 14 are preferably deactivated when the fuel pressure magnitude detected by the fuel pressure sensor 35 becomes equal to or less than the abnormal threshold value and remains so for the predetermined period of time. However, when the fuel pressure magnitude detected by the fuel pressure sensor 35 becomes less than the abnormal threshold value, but does not remain so for the predetermined time period, either both or one of the fuel pump 33 and the engine 14 may be deactivated.

According to such a configuration, it is possible to prevent air suctioned into the fuel pump 33 from entering the engine 14 through the fuel pump 33. As a result, the engine 14 starts smoothly when the engine 14 is restarted after a period of deactivation. Also, in a preferred embodiment described above, the fuel pump 33 and the engine 14 are preferably deactivated when the fuel pressure magnitude detected by the fuel pressure sensor 35 becomes equal to or less than the abnormal threshold value, and remains so for the predetermined period of time. However, instead of deactivating both the fuel pump 33 and the engine 14, either one of the fuel pump 33 and the engine 14 may be separately deactivated. Furthermore, the configuration of the components other than those described above of the water jet propulsion boat according to the various preferred embodiments of the present invention can be accordingly modified within the technical scope of the present invention.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A water jet propulsion boat propelled by a jet pump actuated by an engine activated by a control unit, the water jet propulsion boat comprising:

an engine and a control unit arranged to activate the engine;

a jet pump arranged to propel the water jet propulsion boat, the jet pump arranged to be actuated by the engine;

a fuel tank disposed in a boat body of the water jet propulsion boat;

a fuel pipe extending from the fuel tank to the engine;

a fuel pump activated by the control unit and arranged to deliver fuel from the fuel tank to the engine via the fuel pipe; and a fuel pressure detection unit arranged to detect the pressure of the fuel delivered to the engine by the fuel pump; wherein the control unit is arranged to activate the fuel pump when a magnitude of fuel pressure detected by the fuel pressure detection unit is less than a predetermined magnitude; and the control unit is arranged to deactivate the fuel pump when the magnitude of the fuel pressure detected by the fuel pressure detection unit is equal to or greater than the predetermined magnitude.

2. The water jet propulsion boat according to claim 1, wherein the control unit is arranged to deactivate either one or both of the fuel pump and the engine when the magnitude of the fuel pressure detected by the fuel pressure detection unit becomes equal to or less than a predetermined abnormal threshold value that is less than the predetermined magnitude.

3. The water jet propulsion boat according to claim 2, wherein the control unit is arranged to deactivate either one or both of the fuel pump and the engine when a state in which the magnitude of the fuel pressure detected by the fuel pressure detection unit becomes equal to or less than the abnormal threshold value and remains so over a predetermined period of time.

4. The water jet propulsion boat according to claim 1, wherein the fuel pump is arranged in the fuel tank, and the fuel pressure detection unit is attached to a downstream portion of the fuel pump in the fuel tank.

5. The water jet propulsion boat according to claim 4, wherein the fuel pressure detection unit is attached to an inside of the fuel tank.

6. The water jet propulsion boat according to claim 1, wherein the water jet propulsion boat does not include a pressure adjustment valve.

* * * * *